US005205007A

United States Patent [19]

Goldstein

[11] Patent Number: 5,205,007

[45] Date of Patent: Apr. 27, 1993

[54] RIBBON CURLING TOOL

[76] Inventor: Fredric Goldstein, Liljekungsvagen 186, Vallingby, Sweden, 16242

[21] Appl. No.: 759,188

[22] Filed: Sep. 10, 1991

Related U.S. Application Data

[63] Continuation of Ser. No. 354,624, May 19, 1989, abandoned.

[30] Foreign Application Priority Data

May 19, 1988 [GB] United Kingdom ..... 8811834

[51] Int. Cl.[5] ..... B25F 1/00

[52] U.S. Cl. ..... 7/135; 7/129; 7/158; 226/46

[58] Field of Search ..... 7/135, 125, 129, 131, 7/132, 134, 158; 30/134, 135, 158; 223/46

[56] References Cited

U.S. PATENT DOCUMENTS

| | | | |
|---|---|---|---|
| 1,131,504 | 3/1915 | Garen . | |
| 1,666,801 | 4/1928 | Varney . | |
| 3,284,896 | 11/1966 | Reichborn-Kjennerud | 30/134 |
| 3,327,915 | 6/1967 | Lubin . | |
| 3,530,576 | 9/1970 | Reichborn-Kjennerud | 30/134 |
| 3,681,912 | 8/1972 | Silverman . | |
| 3,883,953 | 5/1975 | Saullo . | |
| 3,954,212 | 5/1976 | Bolis . | |
| 4,152,797 | 5/1979 | Wells, Jr. . | |

FOREIGN PATENT DOCUMENTS

| | | |
|---|---|---|
| 6104760 | 12/1960 | Australia . |
| 4027664 | 1/1964 | Australia . |
| 5643665 | 9/1966 | Australia . |
| 1960283 | 7/1986 | Australia . |
| 5875386 | 12/1989 | Australia . |
| 0368764 | 9/1989 | European Pat. Off. . |
| 3421175 | 12/1985 | Fed. Rep. of Germany . |
| 52-37288 | 3/1977 | Japan . |
| 60-46884 | 3/1985 | Japan . |
| 61-207653 | 9/1986 | Japan . |
| 62-117862 | 5/1987 | Japan . |

OTHER PUBLICATIONS

Windsor Wraps shredder packaging—date unknown.
Saullo sales brochure—date unknown.

*Primary Examiner*—Roscoe V. Parker
*Attorney, Agent, or Firm*—Lerner, David, Littenberg, Krumholz & Mentlik

[57] ABSTRACT

A tool for curling gift-wrapping ribbon has two arms which are pivotally mounted at one end and have a pad and blade at the other end. Closing the arms clamps a ribbon between the pad and blade and the tool can then be drawn along the ribbon to produce a curled effect.

15 Claims, 6 Drawing Sheets

RIBBON CURLING TOOL

This is a continuation of application Ser. No. 07/345,624, filed May 19, 1991, now abandoned.

TECHNICAL FIELD

The present invention relates to a ribbon curling tool.

BACKGROUND ART

When gift-wrapping articles, it is customary to use a non-woven gift wrapping ribbon, which is supplied in various colors and widths, to produce bows and other decorative effects. This type of ribbon is sold by several greeting card companies, such as Hallmark. The ribbon is typically made of polypropylene or any other suitable materials. The nature of this ribbon is such that if tension or shear is applied to one surface of the ribbon, it curls up. This property can be used to produce various pleasing decorative effects, such as ringlets on the ends of ribbon used to tie up a gift package. Typically, to obtain such a decorative, tension is applied to one surface of the ribbon by passing the ribbon over the exposed blade of a pair of scissors or over a knife blade. This usually requires the operator to hold the ribbon against the blade by the pad area of the thumb. It will be appreciated that this is a dangerous operation with a high risk of the operator cutting his hand.

The same effect can be achieved by running a finger nail along the surface of the ribbon. To do this effectively the other surface of the ribbon must be supported on a hard surface and this is not convenient where the ribbon is already applied to the package. It is also more difficult to obtain a uniform curling effect with a finger nail. Another method that has been employed is to wind the free end of the ribbon around a round object such as a pencil. This is a tedious operation and does not produce a curl which will last.

The present invention is directed towards solving the technical problem of providing a tool which can be employed safely to produce a decorative and lasting curled effect on a gift-wrapping ribbon.

DISCLOSURE OF INVENTION

Accordingly, the present invention provides a ribbon curling tool comprising two arms which are movable relative to one another, a blade carried or formed on one arm, and a pad or a corresponding indentation shaped to receive the blade on the other arm, the blade and pad, projection or indentation being positioned such that relative movement of the arms brings the pad or indentation into and out of engagement with the blade.

The tool can readily be made so that it can be operated with one hand. Typically, a package is first wrapped and tied up with the ribbon leaving long free ends on the ribbon. These free ends can then each be separately curled. The ribbon is placed between the blade and the pad, projection or indentation, and the arms closed so that the ribbon is held therebetween. It is important that the ribbon is held such that it is at a shear-inducing angle to the blade. The tool can then be drawn along the length of the ribbon with the ribbon engaged in the nip between the blade and pad, projection or indentation so that one surface of the ribbon is sheared by the blade.

Preferably, the arms of the tool are pivotally mounted together at one end by hinge means which are biased to hold the arms apart. Alternatively, the blade arm may be mounted in a support so that it is spring-biased into a position removed from the pad and can be depressed against the bias of a spring into engagement with the pad by means of an actuating button operated by finger pressure.

In a preferred embodiment, the tool may be further provided with cutting blades which are movable relative to one another so that the end of the ribbon can be cut off at the desired point. With this arrangement, a tool in accordance with the present invention is the only tool needed by the gift-wrapper.

Although the tool is preferably a hand tool, so that ribbons on a variety of awkwardly shaped packages can be curled, it is also possible to mount one arm of the tool to a work surface. This may be a convenient way of ensuring that the tool is not mislaid. For example, a tool in accordance with the present invention can be fixed to a counter where small items such as perfumery are to be gift-wrapped. In one embodiment of such a fixed tool, the fixed arm is mounted to the counter so that the tool is free to rotate about an axis which is generally parallel to the direction of relative movement between the two arms.

BRIEF DESCRIPTION OF THE DRAWINGS

Some embodiments of ribbon curling tools in accordance with the invention will now be described, by way of example only, with reference to the accompanying drawings, in which.

BEST MODE OF CARRYING OUT INVENTION

Figure 1:
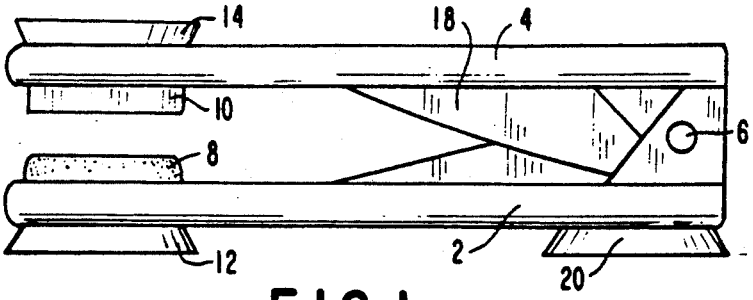
FIG. 1 is a side elevational view of a first embodiment of a ribbon curling tool in accordance with the present invention.

Referring to the drawings, the tool shown in FIG. 1 has two arms, 2, 4 which are pivotally connected at one end by means of a hinge pin 6, which passes through inter-engaged projections provided at the end of both arms 2, 4. A spring (not shown) surrounds the hinge pin 6 to bias the two arms apart into the position shown. At the free end of the lower arm 2, a pad 8 is fixed to the inner surface of the arm 2 which faces the upper arm 4. The pad is made of soft rubber or other resilient material. At the corresponding free end of the upper arm 4, ribbon curling blade 10 is mounted. Finger rests 12, 14 are provided on the opposite sides of each arm adjacent to the blade and pad respectively.

The tool is sized so that it can conveniently be held in the palm of the hand with the tips of the thumb and forefinger engaged on the two finger rests 14, 12 respectively. In this way the operator can pivot the arms 2 and 4 towards one another against the force of the spring so as to clamp a gift-wrapping ribbon between the blade 10 and pad 8. The tool and ribbon can then be moved relative to one another so that the blade 10, which is held transverse to the length of the ribbon, runs along the length of the ribbon to produce the required curl effect.

Adjacent to the hinged end of each arm 2, 4 a scissor blades 16, 18 are provided. The scissor blades 16, 18 are mounted to the facing surfaces of the arms and are aligned such that they move over one another in a scissors cutting action as the arms are pivoted together. The blades can be used by the operator to cut the ribbon at an appropriate point before or possibly after it has been curled, by moving the ribbon, when the arms 2, 4 are apart, backwards from the pad 8, into the gap between the blades 16, 18. Of course, the ribbon curling tool can be provided with a single cutting blade for cutting the ribbon or other material.

A further support 20 is provided on the outer surface of the lower arm 2 adjacent the hinge. This support 20 together with the finger rest 12 opposite the pad 8 provides a stand for the tool.

Figure 2:
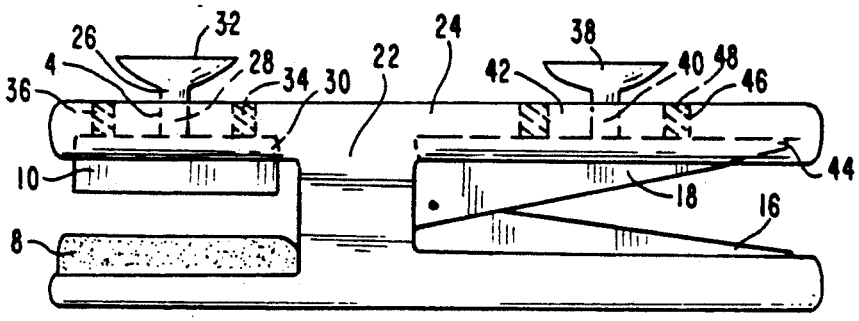
FIG. 2 is a side elevational view through a second embodiment of a ribbon curling tool in accordance with the present invention.

The second embodiment of the cutting tool, shown in FIG. 2, has a lower arm 2 which is intended to be supported on a flat surface such as a counter top. A pillar 22 projects upwardly from the lower arm 2 adjacent the pad 8 and supports a cross-member 24 which provides a support for the upper arm 4. Here, the arm 4 is simply the blade 10 itself which is mounted on a shaft 26 which extends through a corresponding bore 28 in the cross-member 24. The bore 28 opens into a recess 30 sized to receive the blade 10. The free end of the shaft which projects above the cross-member 24 carries an actuating button 32 by which the blade can be pressed into contact with the pad. Springs 34, housed in bores 36, opening into the recess 30, are connected to the blade 10 at one end and to the cross-member 24 at their other ends. The springs 34 normally retract the blade 10 away from the pad 8. The blade 10 is brought into contact with the pad 8 when the button 32 is depressed against the retracting force of the springs 34.

As in the first embodiment, this tool is provided with scissors blades 16, 18. One blade 16 is fixedly mounted to the lower arm 2 on the side of the pillar 22 opposite the pad 8. The other scissor blade 18 is mounted in a similar fashion so that it is moveable towards and away from the arm 2 in overlying engagement with the other blade 16 to produce a scissor cutting action. The movement of the upper scissor blade 18 is controlled by means of an actuating button 38 mounted to the end of a shaft 40 which extends through a corresponding bore 42 in the cross-member 24. The bore 42 opens into a recess 44 into which the blade is retracted under the biasing force of the springs 46. The springs 46 are housed in the respective bores 48, and each have one of their ends being secured to the blade 18 and their other ends secured to the cross-member 24.

The lower arm 2 may be fixedly mounted to a counter or may be mounted by means of a spindle which projects upwardly into the pillar 22 so that the tool can be rotated around an axis defined by the pillar 22.

Figure 3:
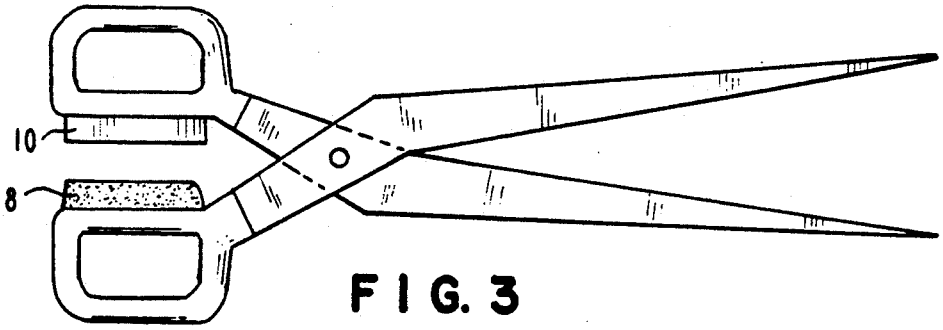
FIG. 3 is a side elevational view of a third embodiment in accordance with the present invention, comprising a conventional pair of scissors modified to provide a combined ribbon curling tool and scissors; in accordance with the present invention.

FIG. 3 shows a conventional pair of scissors which have had their handles modified so that the handles can be used as a ribbon curling tool. In this case, the blade is mounted to the inner face of one handle and the pad 8 is mounted to the co-operating face of the other handle so that the handles are serving as the arms of the ribbon curling tool. The sizes of the pad and blade as shown in FIG. 3 have been exaggerated for clarity. It will be appreciated that the required blade and pad may be produced by modifying the actual handles so that part of one handle is made as a metal or plastics blade and part of the other as a resilient pad.

Figure 4:
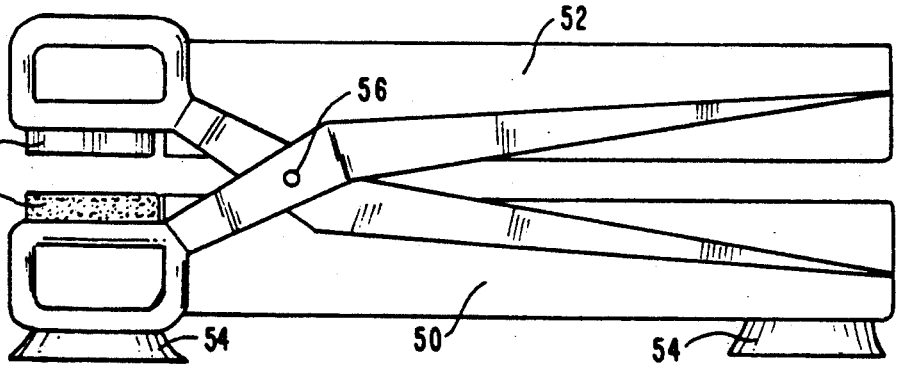
FIG. 4 is a side elevational view of a stand in which the combined ribbon curling tool and scissors of FIG. 3 may be mounted.

To operate the last-described embodiment, it will be appreciated that the operator must hold the blades of the scissors in order to curl the ribbon. This may result in some risk of injury and, accordingly, a stand is provided to hold the scissors as illustrated in FIG. 4. This stand provides a seat 50, 52 for each of the blades. The lower seat 50 is provided with a foot 54 at each end so that the stand can be supported on a flat surface. The foot adjacent the handle provides a support for the handle. Each seat 50, 52 is provided with a recess into which the blade of the scissors fits. The seats 50, 52 may be made of a resilient material so that the scissors are firmly held once the blades have been force-fitted into their respective recesses. Alternatively, the seats may be permanently molded around the scissors leaving only a portion of the cutting edges exposed so that the modified scissors can still perform a cutting operation. The seats and scissors then become the two arms of the tool and the pivot 56 of the scissors serves to mount the arms so that they are relatively moveable.

Figure 5:
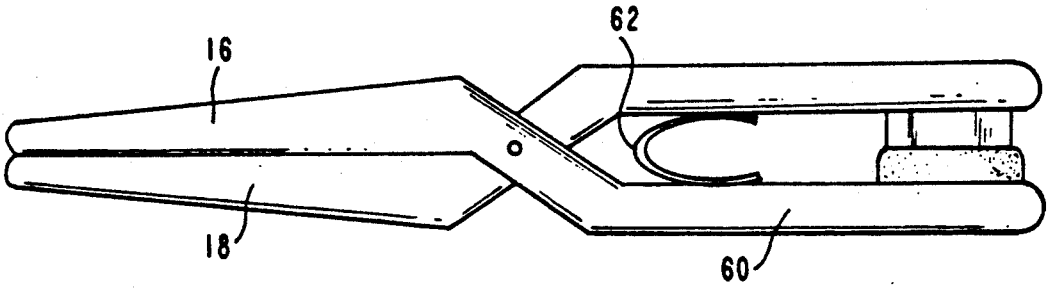
FIG. 5 is a side elevational view of a fourth embodiment of a ribbon curling tool in accordance with the present invention, illustrated in a closed, ribbon curling position.
Figure 6:
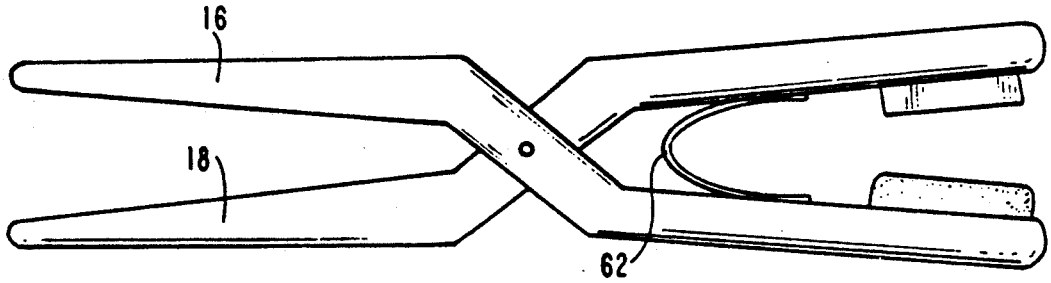
FIG. 6 is a side elevational view of the ribbon curling tool shown in FIG. 5 in the open position.

The tool shown in FIGS. 5 and 6 is essentially similar to the tool based on a pair of scissors. However in this case the handles are straight arm members which are each joined to a respective scissor blades 16, 18. A leaf spring 62 is fixed between the two arms 58, 60 with one end attached to the facing surface of each arm, in order to normally bias the arms apart into the position shown in FIG. 5. As in the previous embodiments, one arm carries the curling blade and the other arm the blade receiving pad.

Figure 7:
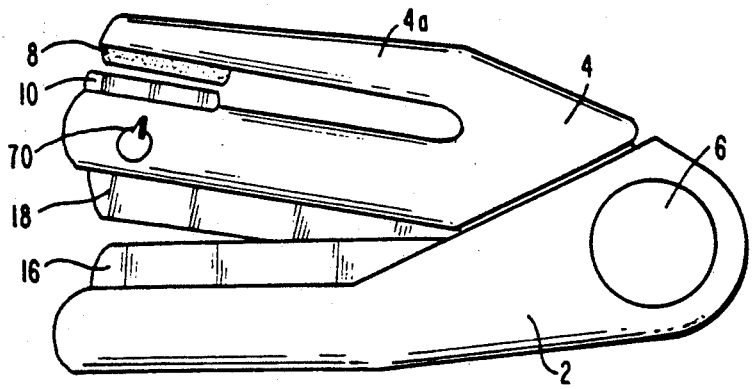
FIG. 7 is a side elevational view of a fifth embodiment of a ribbon curling tool in accordance with the present invention.
Figure 8:
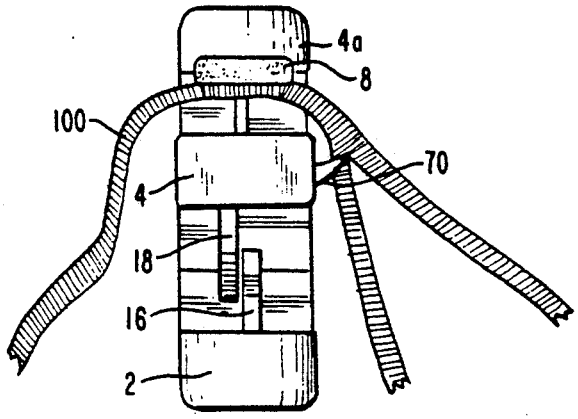
FIG. 8 is a front elevational view of the ribbon curling tool shown in FIG. 7, illustrating the curling and splitting of a piece of ribbon.

FIGS. 7 and 8 show yet another embodiment, the fifth embodiment, of a ribbon curling tool in accordance with the present invention. In this embodiment, many of the features of the previous embodiments remain. For instance, the arms 2, 4 are hinged at hinge pin 6 and include scissor blades 16, 18, respectively. In this embodiment, however, the arm 4 includes a secondary arm 4*a* which is integral with arm 4 and carries pad 8 at its free end, pad 8 being adjacent curling blade 10 which is on the upper surface of arm 4. Secondary arm 4*a* is, in accordance with the principles underlying the present invention, flexible at its point of connection to arm 4 so that pad 8 can be forcibly brought into contact with curling blade 10. A splitting hook 70 is provided on the arm 4 to split the ribbon 100 as depicted in FIG. 8. This embodiment of the ribbon curling tool is operated in a similar fashion to the previous embodiments, with the additional, yet optional, feature of the splitting hook to split the ribbon 100 after being curled between the pad 8 and the curling blade 10.

Figure 9:
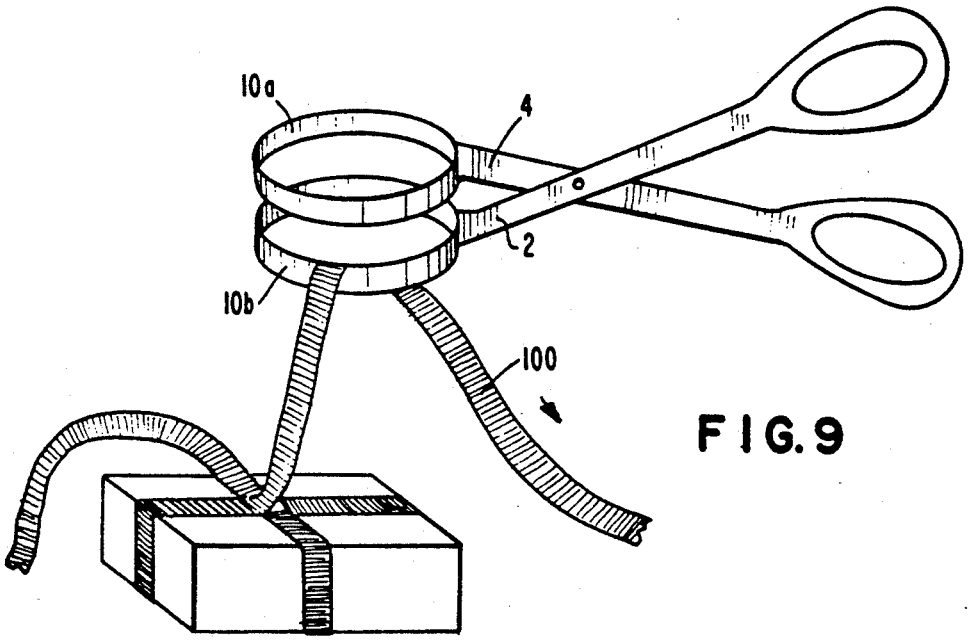
FIG. 9 is a perspective view of a sixth embodiment of a ribbon curling tool in accordance with the present invention, illustrating the curling of a piece of ribbon already wrapped about a gift.

FIG. 9 shows the sixth embodiment of the present invention. This embodiment is primarily in the shape of a pair of scissors, but instead of scissor blades on the arms 2 and 4, ring shaped curling blades 10*a* and 10*b* are provided to impart the shearing forces required to curl ribbon 100 as ribbon 100 is pulled through the ring shaped curling blades 10*a* and 10*b* when the ring shaped curling blades 10*a* and 10*b* are clamped on the ribbon 100.

Figure 10:
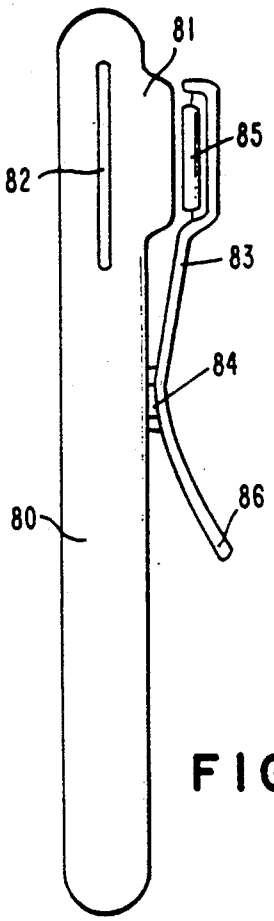
FIG. 10 is a side elevational view of a seventh embodiment of a ribbon curling tool in accordance with the present invention.

FIG. 10 is a seventh embodiment of the present invention, comprising an elongate handle 80 having a protrusion 81 extending from one side of the handle 80, and a curling blade 82 extending perpendicularly to the protrusion 81. An arm 83 is hingedly connected, at hinge 84, to the handle 80. The arm 83 includes a barrel member 85 which is normally in contact with the protrusion 81 of the handle 80. This barrel member 85 can be in the shape an elongate cylinder and be rotatable to reduce the friction imparted to a ribbon being drawn between the barrel member 85 and the protrusion 81 (noting that it is the shearing forces imparted by curling blade 8 which curls the ribbon). Barrel member 85 can also be a stationary member of any shape so long as the material or structure of the barrel member 85 reduces the friction imparted to a ribbon being drawn between the barrel number 85 and the protrusion 81. The arm 83 also includes an actuation member 86 which can be depressed towards the handle 82 to move the barrel 85 away from the protrusion 81 so that a ribbon can be inserted therebetween. Of course, it is desirable that the arm 83 be pre-stressed in some manner or the hinge 84 include means, perhaps spring means, such that the barrel member 85 is normally in contact with the protrusion 81. To operate the embodiment shown in FIG. 10, the actuation member 86 is depressed so that a ribbon can be inserted between the barrel member 85 and the protrusion 81. Once the actuation member 86 is released and the ribbon is clamped between the barrel member 85 and the protrusion 81, the ribbon can be pulled in the manner described above with respect to other embodiments to curl the ribbon against the curling blade 82. In the alternative, and preferable with respect to this embodiment, the ribbon curling tool can be drawn along the ribbon in fashion similar to that shown in FIG. 12 with respect to the eighth embodiment.

Figure 11:
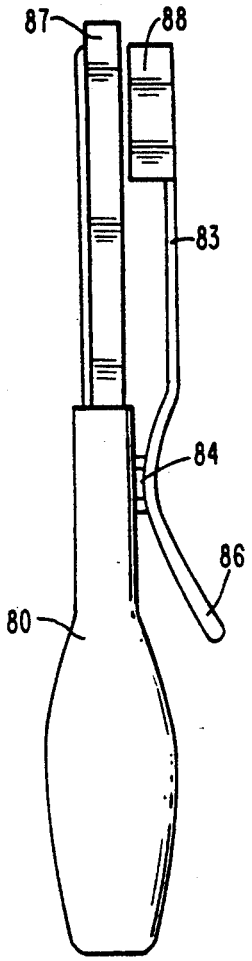
FIG. 11 is a side elevational view of an eighth embodiment of a ribbon curling tool in accordance with the present invention.
Figure 12:
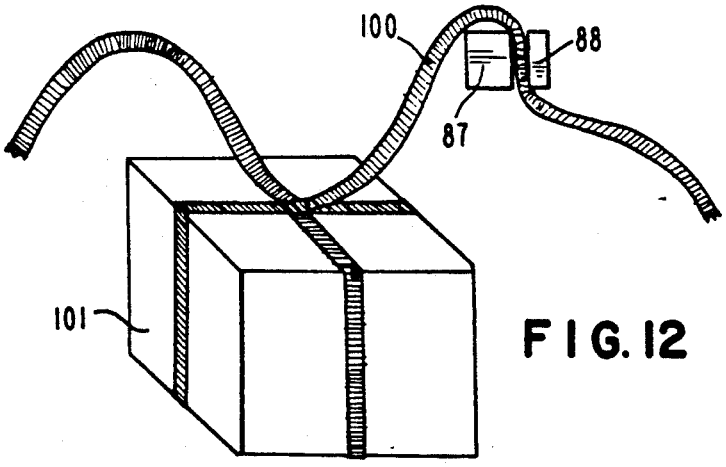
FIG. 12 is a top view of the ribbon curling tool shown in FIG. 11, illustrating the curling of a ribbon already wrapped about a gift.
Figure 13:
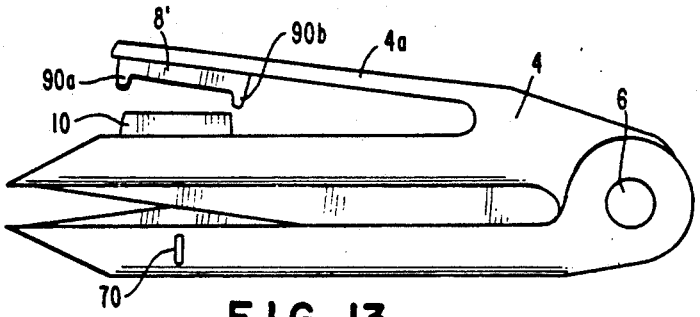
FIG. 13 is side elevational view of a ninth embodiment of a ribbon curling tool in accordance with the present invention.

FIGS. 11 and 12 show an eighth embodiment of the present invention. This embodiment is similar in many respects to the seventh embodiment shown in FIG. 10. Thus, it includes a handle 80, an arm 83, a hinge 84 and an actuation member 86. The handle 80, however, includes a longitudinally extending curling blade or bar 87, against which a ribbon 100 is to be curled. It is noted that the curling bar 87 can be made of virtually any hard material, whether it be of a metal such as steel or a plastic. Adjacent the curling bar 87, the arm 83 includes a pad 88 which is normally in contact with the curling bar 87 by virtue of the structure of arm 83 and the manner in which arm 83 is connected to the handle 80.

The embodiment shown in FIGS. 11 and 12 is operated in the same manner as the embodiment shown in FIG. 10. Thus, FIG. 12 shows, from a top view, how the ribbon 100 of a gift 101 is curled by drawing the ribbon curling tool such that the angle of the ribbon 100 against the curling bar 87 provides the required shearing effect to curl the ribbon 100.

Figure 14:
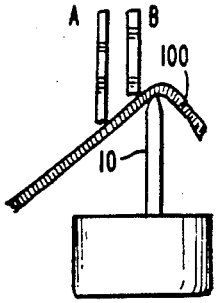
FIG. 14 is a schematic front view of the ribbon curling tool shown in FIG. 13, illustrating two different positions for the ribbon curling means indicated as A in the first position and indicated by B in the second position.
Figure 15A:
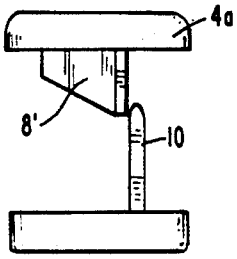
FIG. 15A is a front view of the ribbon curling tool shown in FIG. 13.
Figure 15B:
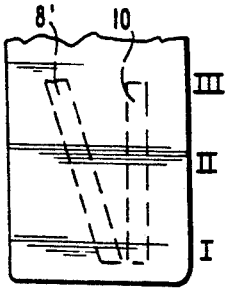
FIG. 15B is a top view of the ribbon curling tool shown in FIG. 13.
Figure 15C:
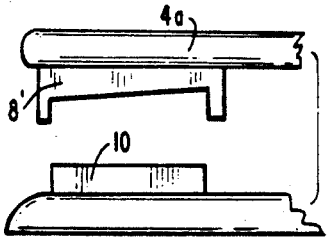
FIG. 15C is a side elevational view of the ribbon curling tool shown in FIG. 13, illustrating a modification of the blade receiving means.
Figure 16:
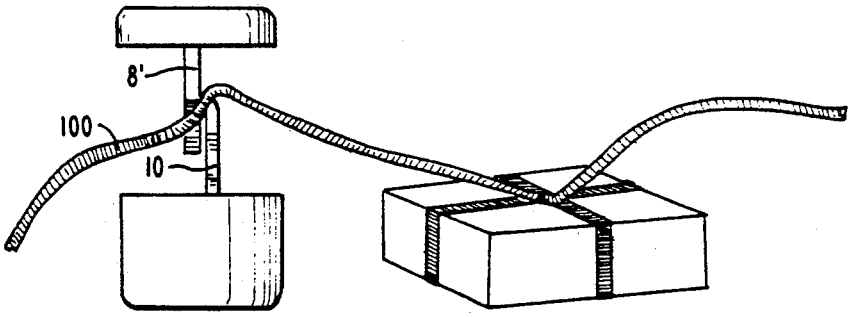
FIG. 16 is a front view of the ribbon curling tool shown in FIG. 13, illustrating the manner in which a ribbon of a package is effectively curled by a ribbon curling tool.

FIGS. 13–16 show a ninth embodiment of the present invention, this embodiment being quite similar to the embodiment shown in FIGS. 7 and 8. Accordingly, similar components and elements of the embodiment shown in FIGS. 13–16 will not be described again, as it is only the ribbon curling means on secondary arm 4*a* which differs. In this embodiment, the blade 10 does not abut the ribbon curling projection 8', but rather is juxtaposed as shown in FIGS. 14–16 when secondary arm 4*a* is depressed. In this embodiment, the ribbon 100 bends over the blade 10 and under the ribbon curling projection 8', as shown in FIG. 16. Of course, the blade 10 and the ribbon curling projection 8' must be sufficiently close to one another in the lateral direction that the ribbon is at a shear inducing angle with respect to the blade 10 and/or the ribbon curling projection 8'. The smaller this angle becomes, that is, the closer the blade 10 is to the ribbon curling projection 8', the tighter the resulting curls will be.

Another factor which will affect the angle of the ribbon when clamped as shown in FIG. 16, is the depth to which the ribbon curling projection 8' extends when the secondary arm 4*a* is depressed. That is, the further the ribbon curling projection 8' extends beyond the tip or edge of blade 10, the tighter the angle of the ribbon 100 will become. Of course, the angle is preferably less than 90° to impart any curl inducing shear action on the ribbon 100. It is stressed that the larger the angle of the ribbon 100 is to the blade 10, the larger the resulting curls will be; and the smaller the angle of the ribbon is to the blade 10, the smaller or tighter the resulting curls will be.

It is therefore possible with this embodiment to provide a ribbon curling tool which will always provide the same sized curls. This is accomplished by the legs or positive stop means 90*a* and 90*b*. These positive stop means 90*a* and 90*b* are adapted to abut the portion of arm 4 which supports the blade 10 so that the ribbon curling projection 8' extends a predetermined distance below the tip of blade 10. In this manner, the desired angle of the ribbon 100 and thus the resulting curl, can be guaranteed on each use of the ribbon curling tool. The positive stop means 90*a*, 90*b* can also be constructed so that they also act as lateral guide means for the secondary arm 4*a*. By so configuring the positive stop means 90*a* and 90*b*, the secondary arm 4*a* cannot be moved laterally out of alignment with the blade 10. The positive stop mean 90*a* and 90*b* can also act as stop means to prevent the ribbon from being inserted too far towards the apex of the secondary arm 4*a* and the primary section of arm 4. One such configuration of the positive stop means 90*a* and 90*b* could be in a U-shape so that if the secondary arm 4*a* is moved in either lateral direction, the ribbon curling projection will remain substantially in alignment with the blade 10 for curling a ribbon 100 in the desired manner. Of course, separate lateral guide means can be provided for this purpose.

As stated above, it is both the distance the ribbon curling projection 8' is from the blade 10 and the depth to which the ribbon curling projection 8' is permitted to extend which defines the angle of the ribbon with respect to the blade 10, and thus the size of the curls produced by the ribbon curling tool. FIG. 14 shows the positioning of two different ribbon curling projections, the first being labeled A and the second being labeled B. As can be seen in FIG. 14, the ribbon curling projection B is closer to the blade 10 in the lateral direction but does not extend very far along the side of blade 10. The ribbon curling projection A, however, is further from the blade 10 in a lateral direction, yet extends along the side of blade 10 for a greater distance than the ribbon curling projection B. The ribbon 100, therefore, is at the same angle with respect to the blade 10 against either the ribbon curling projection A or the ribbon curling projection B. Thus, FIG. 14 demonstrates that these two factors are dependant upon one another in defining the angle of the ribbon 100 with respect to the blade 10. These two factors could be said to be on a sliding scale with respect to one another in defining the angle of the ribbon to the blade 10.

Using this principle, FIGS. 15A and 15B demonstrate that the ribbon curling tool in accordance with the current embodiment can be designed to provide curls of several different sizes depending upon where the ribbon is inserted along the blade 10 and ribbon curling projection 8'. Thus, FIG. 15B shows that the ribbon curling projection 8' is set at an angle to blade 10 in top view so that it is closer to the blade 10 at the portion labeled I and extends increasingly further from the blade 10 in the lateral direction, as at II and III. Accordingly, if smaller curls are desired, one would place the ribbon in the area designated I, i.e., towards the front of the ribbon curling tool; and if larger curls are desired, one would place a ribbon towards the rear of the ribbon curling tool as at III. A similar affect can be provided by angling the ribbon curling projection as shown in FIG. 15C. Thus, the structure of the ribbon curling projection 8' in FIG. 15C is such that when the secondary arm 4*a* is depressed, and the positive stop means 90*a* and 90*b* fix it at a predetermine position, the front of the ribbon curling projection 8' extends along side the blade 10 further than the rear portion of the ribbon curling projection 8'. Thus, as described above, the front of the ribbon curling projection 8' as shown in FIG. 15C will lessen the angle of the ribbon 100 to produce tighter curls. Of course, a ribbon curling projection 8' which combines the structure shown in FIG. 15B with the structure shown in FIG. 15C can also be used to provide a ribbon curling tool which can provide a plurality of different sized curls.

Examples of distances between the ribbon curling projection 8' and the blade 10 which might provide desirable curling effects are 1 millimeter in the area of I; 1.5 millimeters in the area of II; and two millimeters in the area of III.

Referring to FIG. 14, one particular set of distances which would provide the same angle for ribbon 100 are; projection B being 1 millimeter from the side of blade 10 and 1 millimeter below the tip of blade 10: whereas projection A is 2 millimeters from the side of blade 10 and 2 millimeters below the tip of blade 10. The angle of a ribbon against either projection A or B would be 45°. It should be noted that the angle of the ribbon 100 to the blade 10 is correlative to the corresponding pressure exerted thereon. Thus, unlike other embodiments of the present invention, one need not (and indeed cannot because of the positive stop means) exert additional pressure to produce a tighter curl—it will be inherent in the position of the projection 8' relative to the blade 10.

Figure 17:
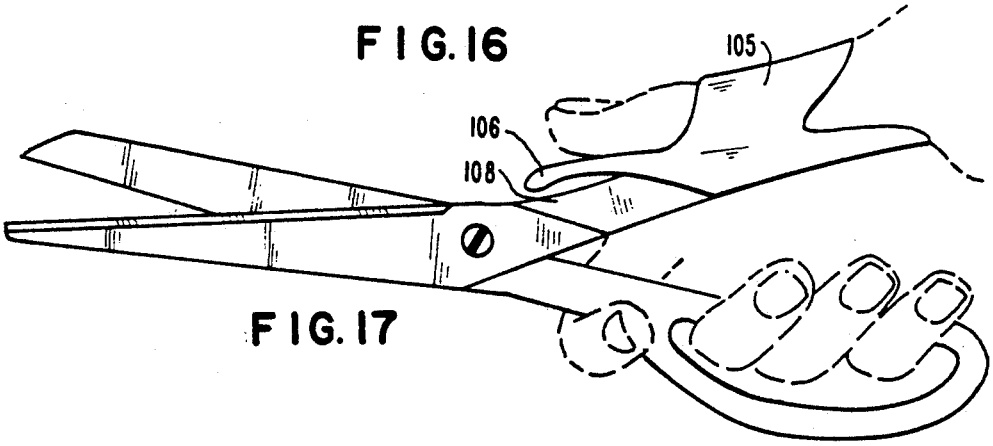
FIG. 17 is a side elevational view of a tenth embodiment in accordance with the present invention, comprising a modification of a conventional pair of scissors.
Figure 18:
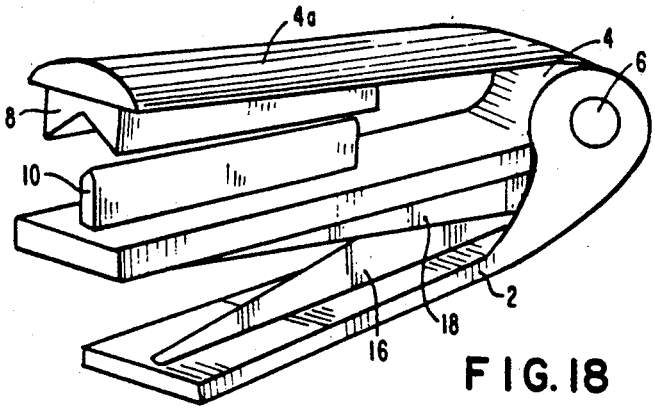
FIG. 18 is a front perspective view of a ribbon curling tool in accordance with an eleventh embodiment of a ribbon curling tool in accordance with the present invention.
Figure 19:
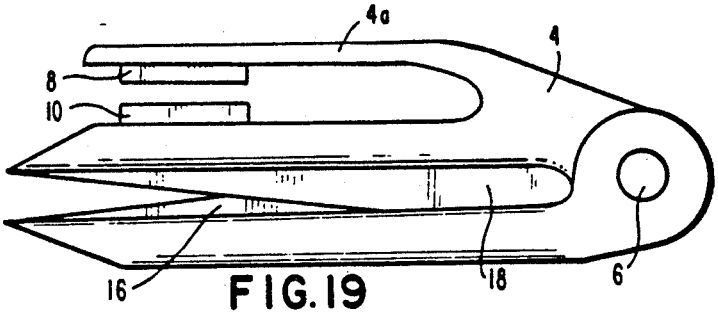
FIG. 19 is a side elevation view of the ribbon curling tool shown in FIG. 18.
Figure 20:
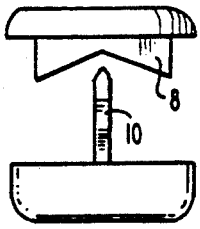
FIG. 20 is a front elevational view of the ribbon curling tool shown in FIG. 18.
Figure 21:
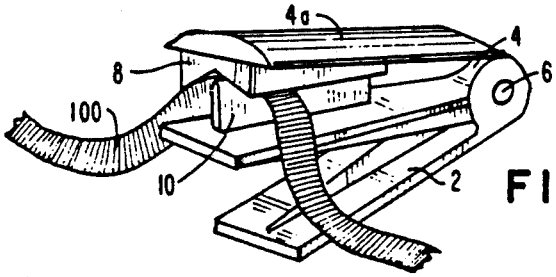
FIG. 21 is a front perspective view of the ribbon curling tool shown in FIG. 18, illustrating the manner in which a piece of ribbon is curled thereby.

FIG. 17 is a tenth embodiment of a ribbon curling tool in accordance with the present invention. The embodiment in FIG. 17 is similar to the embodiment in FIGS. 3 and 4 insofar as it comprises a modification of a conventional pair of scissors. In this embodiment, however, one handle of a conventional pair of scissors is modified to provide a sleeve 105 for receiving the thumb of an individual. When one's thumb is comfortably within the sleeve 105, the thumb will be adjacent a combined actuation member and pad 106. This combined actuation member and pad 106 is flexible such that one's thumb can depress the same against a ribbon which is positioned between the combined actuation member and pad 106 and the curling blade 108 which is provided on the handle of the scissors. Thus, to operate this embodiment of the present invention, a ribbon is inserted between the pad 106 and the blade 108, the pad 106 is depressed to clamp the ribbon between the pad 106 and the blade 108, and the ribbon is drawn through these elements. The resultant shearing action effectively curls the ribbon.

FIGS. 18–21 show an eleventh embodiment of the present invention, this embodiment again being quite similar to the embodiment shown in FIGS. 7 and 8, and therefore, similar components and elements of this embodiment will not be described again. What differs in this embodiment is that the pad 8 includes an inverted V-shaped groove which is adapted to receive the blade 10. This embodiment is particularly directed to the use of a rigid pad as opposed to a resilient pad. The inverted V-shaped indentation obviates the need for a resilient pad insofar as the curl-inducing angle for the ribbon to be curled is established as soon as the ribbon is clamped between the blade 10 and in the inverted V-shaped indentation of the pad 8. With a resilient pad, additional force must be applied to sufficiently depress the resilient pad such that the proper angle for the ribbon is established, this proper angle aiding in the shearing action imparted to the ribbon.

Figure 22:
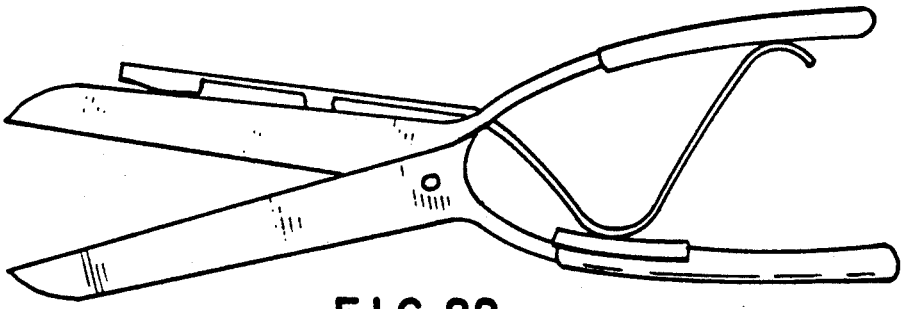
FIG. 22 is a side elevational view of yet another embodiment in accordance with the present invention.

FIG. 22 shows yet another embodiment of the ribbon curling tool. In this embodiment, a spring member is adapted to be depressed between two handles of a scissor-like instrument to simultaneously direct the pad forward and downward against the curling blade.

In any of the foregoing embodiments or any other embodiment of the ribbon curling tool in accordance with the present invention, the pad may be replaced by other blade receiving means which is adapted to hold the ribbon at an angle with respect to the blade so that the ribbon is sheared to thereby induce the curling thereof. Of course, it is intended that the features and elements of the various embodiments be interchangeable with one another insofar as may be practicable.

Thus, a ribbon curling tool for curling and cutting a gift-wrapping ribbon has been described. It will be understood that the present invention is not to be limited to the specific structure or embodiments shown and described above, the words which have been used being words of description rather than limitation, but that the same may be modified within the spirit and scope of the invention as defined by the appended claims.

Industrial Applicability

The present invention pertains to a device for imparting a curl to a length of ribbon used for wrapping and decorating a gift, or generally for decoration.

I claim:

1. A ribbon curling device to facilitate the curling of a length of ribbon, said ribbon curling device comprising:

a. a first arm having a primary section and a secondary section, said secondary section being connected to said primary section at a first end and being spaced from said primary section at a second end;

b. a second arm connected to said first arm, said second arm being moveable relative to said first arm, said primary section of said first arm and said second arm including cutting means for cutting a piece of ribbon or other material;

c. first curling means on said primary section; and d. second curling means on said secondary section adjacent said first curling means, said primary section and said secondary being moveable relative to one another so that said first curling means and said second curling means can clamp a ribbon therebetween to facilitate the curling thereof.

2. The ribbon curling device claimed in claim 1, further comprising ribbon splitting means to split a ribbon into at least two pieces.

3. A ribbon curling device to facilitate the curling of a length of ribbon, said ribbon curling device comprising:

a. a first arm;

b. a second arm connected to said first arm;

c. a first curling blade on said first arm, said first curling blade being elongate and including a first edge adapted to engage a length of ribbon;

d. a second curling blade on said second arm, said second curling blade being elongate and including a second edge adapted to engage a length of ribbon, said first curling blade an said second curling blade being moveable relative to one another to hold a ribbon therebetween and to exert curl-inducing shearing forces on a length of the ribbon and being arranged to be side-by-side with one another when moved together to thereby hold the ribbon at an angle to said first curling blade, wherein one of said first edge or said second edge is offset with respect to the other so that the distance to which the second curling blade is moved below said first edge of said first curling blade varies from one end of the second curling blade to the other, thereby permitting the ribbon to be held at different angles depending upon where it is placed between said first and second curling blades.

4. The ribbon curling device in claim 3, further comprising cutting means on said ribbon curling device for cutting a ribbon or other material.

5. A ribbon curling device to facilitate the curling of a length of ribbon, said ribbon curling device comprising:

a. a first member having an elongate first curling blade having a first edge; and b. a second member having an elongate second curling blade having a second edge, both said first and second edges being adapted to engage a length of ribbon, at least one of said first and second curling blades being movable relative to the other so that said first and second curling blades can be moved from an open position to a curling position, said first and second curling blades being in a side-by-side relationship with one another when in said curling position, said first and second curling blades being so constructed and arranged with respect to one another that when a ribbon is inserted between said first and second curling blades and said first and second curling blades are moved into said curling position, a curl-inducing angle is established on the ribbon between said first and second edges by virtue of the arrangement of said first and second curling blade with respect to each other, said curl-inducing angle being created without substantial manual positioning of the ribbon with respect to said first and second curling blades when moving the ribbon through said device, wherein said first curling blade is arranged at a lateral angle to said second curling blade such that when the first and second curling blades are in said curling position, the lateral distance between said first and second curling blades varies from small to larger.

6. The ribbon curling device in claim 5, wherein said first edge of said first curling blade is at an angle to said second edge of said second curling blade when said first and second curling blades are in said curling position, thereby enabling a length of ribbon to be held at different angles depending upon where it is placed between said first and second edges.

7. The ribbon curling device in claim 6, further comprising positive stop means to limit the movement of said at least one of said first and second curling means, thereby defining the arrangement of said first and second curling means in said curling position.

8. The ribbon curling device of claim 5, further comprising positive stop means to limit the movement of said at least one of said first and second curling means, thereby defining the arrangement of said first and second curling means in said curling position.

9. The ribbon curling device in claim 5, wherein one of said first and second edges is sharp.

10. A ribbon curling device to facilitate the curling of a length of ribbon, said ribbon curling device comprising:

a. a first member having an elongate first curling blade having a first edge; and b. a second member having an elongate second curling blade having a second edge, both said first and second edges being adapted to engage a length of ribbon, at least one of said first and second curling blades being movable relative to the other so that said first and second curling blades can be moved from an open position to a curling position, said first and second curling blades being in a side-by-side relationship with one another when in said curling position, said first and second curling blades being so constructed and arranged with respect to one another that when a ribbon is inserted between said first and second curling blades and said first and second curling blades are moved into said curling position, a curl-inducing angle is established on the ribbon between said first and second edges by virtue of the arrangement of said first and second curling blades with respect to each other, said curl-inducing angle being created without substantial manual positioning of the ribbon with respect to said first and second curling blades when moving the ribbon through said device, wherein said first edge of said first curling blade is at an angle to said second edge of said second curling blade when said first and second curling blades are in said curling position, thereby enabling a length of ribbon to be held at different angles depending upon where it is placed between said first and second edges.

11. The ribbon curling device of claim 10, further comprising positive stop means to limit the movement of said at least one of said first and second curling means, thereby defining the arrangement of said first and second curling means in said curling position.

12. The ribbon curling device in claim 10, wherein one of said first and second edges is sharp.

13. A ribbon curling device to facilitate the curling of a length of ribbon, said ribbon curling device comprising:

a. a first member having first curling means;

b. a second member having second curling means at least one of said first and second curling means being movable relative to the others so that said first and second curling means can be moved from an open position to a curling position, said first and second curling means being so constructed and arranged with respect to one another that when a ribbon is inserted between said first and second curling means and said first and second curling means are moved into said curling position, a curl-inducing angle is established on the ribbon by virtue of the arrangement of said first and second curling means with respect to each other, said curl-inducing angle being created without having to manually manipulate the ribbon with respect to said first and second curling means, said first and second curling means having means for establishing at least two different curl-inducing angles on the ribbon when the first and second curling means are in said curling position, whereby the ribbon can be curled into one of at least two different sizes, said at least two sizes of curls corresponding to said at least two curl-inducing angles, said ribbon curling device further including indicia to designate the locations at which said at least two different curl-inducing angles are established when a ribbon is placed between said first and second curling means.

14. The ribbon curling device in claim 13, wherein said first and second curling means are first and curling blades which are arranged at a lateral angle to one another such that the lateral distance between said first and second curling blades varies from small to larger, whereby the curl-inducing angle varies with such lateral distance.

15. The ribbon curling device in claim 13, wherein said first and second curling means are first and second curling blades having first and second edges, respectively, and wherein said first edge of said first curling blade is at an angle to said second edge of said second curling blade when said first and second curling blades are in said curling position, thereby enabling a length of ribbon to be held at different angles depending upon where it is placed between said first and second edges.

* * * * *